US005354224A

United States Patent [19]

Ishiyama

[11] Patent Number: 5,354,224

[45] Date of Patent: Oct. 11, 1994

[54] BLOCK TOY INCLUDING A PLURALITY OF BLOCKS THAT CAN BE VARIOUSLY ASSEMBLED TO CREATE DIFFERENT GRAPHICAL IMAGES AND INCLUDING APERTURED BLOCKS HAVING ENGAGEMENT SURFACES WHICH EXTEND FROM EDGES OF THE APERTURES INTO THE BLOCKS

[75] Inventor: Sozo Ishiyama, Chiba, Japan

[73] Assignee: Kabushiki Kaisha Gakushu Kenkyusha, Tokyo, Japan

[21] Appl. No.: 2,710

[22] Filed: Jan. 11, 1993

[51] Int. Cl.[5] ..... A63H 33/04; A63H 33/08

[52] U.S. Cl. ..... 446/117; 446/110; 446/85

[58] Field of Search ..... 446/128, 125, 117, 69, 446/121, 118, 119, 120, 84, 124, 110, 85; 434/159, 259, 403; 273/156, 157 R, 160

[56] References Cited

U.S. PATENT DOCUMENTS

| | | | |
|---|---|---|---|
| D. 157,463 | 2/1950 | Burger | 273/160 |
| D. 277,946 | 3/1992 | Farrell | 434/259 |
| 2,528 | 3/1867 | Hill | 434/159 |
| 168,229 | 9/1875 | Chinnock | 434/159 |
| 243,362 | 6/1881 | Crandall | 446/69 |
| 1,574,257 | 2/1926 | Redner | 434/403 |
| 2,278,894 | 4/1942 | Paulson | 446/124 |
| 3,479,751 | 11/1969 | Welbourn | 434/259 |
| 5,129,453 | 8/1992 | Aiken et al. | 446/489 |

FOREIGN PATENT DOCUMENTS

| | | | |
|---|---|---|---|
| 660422 | 7/1929 | France | 446/117 |

*Primary Examiner*—Robert A. Hafer
*Assistant Examiner*—Michael O'Neill
*Attorney, Agent, or Firm*—Irving M. Weiner; Joseph P. Carrier; Pamela S. Burt

[57] ABSTRACT

A block toy has a plurality of regular hexahedral blocks each having a relief side having a relief surface, a printed side having a printed surface, and an apertured side having an aperture defined therein. A plurality of smaller blocks, which have sizes smaller than the regular hexahedral blocks, are each positionable on the apertured side of one of the regular hexahedral blocks when the smaller blocks are oriented in one direction. The smaller blocks can be fitted in the apertured side of one of the regular hexahedral blocks when the smaller blocks are oriented in an opposite direction.

22 Claims, 9 Drawing Sheets

BLOCK TOY INCLUDING A PLURALITY OF BLOCKS THAT CAN BE VARIOUSLY ASSEMBLED TO CREATE DIFFERENT GRAPHICAL IMAGES AND INCLUDING APERTURED BLOCKS HAVING ENGAGEMENT SURFACES WHICH EXTEND FROM EDGES OF THE APERTURES INTO THE BLOCKS

BACKGROUND OF THE INVENTION

1. Field of the Invention

The present invention relates to a block toy comprising a plurality of various blocks that can be assembled in various patterns in order for the player to play in a variety of different ways.

2. Description of the Prior Art

One known block toy is composed of a plurality of blocks each bearing one or more graphic designs on one or more sides thereof. Some or all of the blocks may be assembled in a predetermined pattern to complete a single picture on the particular sides of the combined blocks. Another conventional block toy comprises a plurality of interfitting blocks that can be complementarily fitted together, just like a jigsaw puzzle, thereby making up a single picture.

Since these prior block toys are very simple to play with, the player soon gets used to the process in which the blocks are to be assembled, and hence can easily complete the combination of blocks to achieve desired pictures. Therefore, the conventional block toys are disadvantageous in that the player tends to quickly lose interest in them after he has played with the block toys several times.

SUMMARY OF THE INVENTION

It is therefore an object of the present invention to provide a block toy composed of various blocks that may be assembled in various ways to complete different graphic patterns or figures.

According to the present invention, there is provided a block toy comprising a plurality of regular hexahedral blocks each having at least one side bearing graphic information, and an apertured side, and a plurality of smaller blocks having sizes smaller than the regular hexahedral blocks, each of the smaller blocks being positionable on the apertured side of one of the regular hexahedral blocks when the smaller blocks are oriented in one direction, and fittable in the apertured side of one of the regular hexahedral blocks when the smaller blocks are oriented in an opposite direction.

According to the present invention, there is also provided a block toy comprising a plurality of regular hexahedral blocks each having a relief side having a relief surface, a printed side having a printed surface, and an apertured side having an aperture defined therein, and a plurality of smaller blocks having sizes smaller than the regular hexahedral blocks, each of the smaller blocks being positionable on the apertured side of one of the regular hexahedral blocks when the smaller blocks are oriented in one direction, and receivable in one of the regular hexahedral blocks through the aperture in the apertured side thereof when the smaller blocks are oriented in an opposite direction.

According to the present invention, there is further provided a block toy comprising a plurality of regular hexahedral blocks each having at least one side bearing graphic information, and an apertured side, the regular hexahedral blocks having respective first holders disposed therein, a plurality of first smaller blocks smaller than the regular hexahedral blocks, the first smaller blocks having respective second holders disposed therein, each of the first smaller blocks being positionable on the apertured side of one of the regular hexahedral blocks when the first smaller blocks are oriented in one direction, and fittable in the first holder of one of the regular hexahedral blocks through the aperture when the first smaller blocks are oriented in an opposite direction, and a plurality of second smaller blocks smaller than the first smaller blocks, each of the second smaller blocks being positionable on one of the first smaller blocks when the second smaller blocks are oriented in one direction, and fittable in the second holder of one of the first smaller blocks when the second smaller blocks are oriented in an opposite direction.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
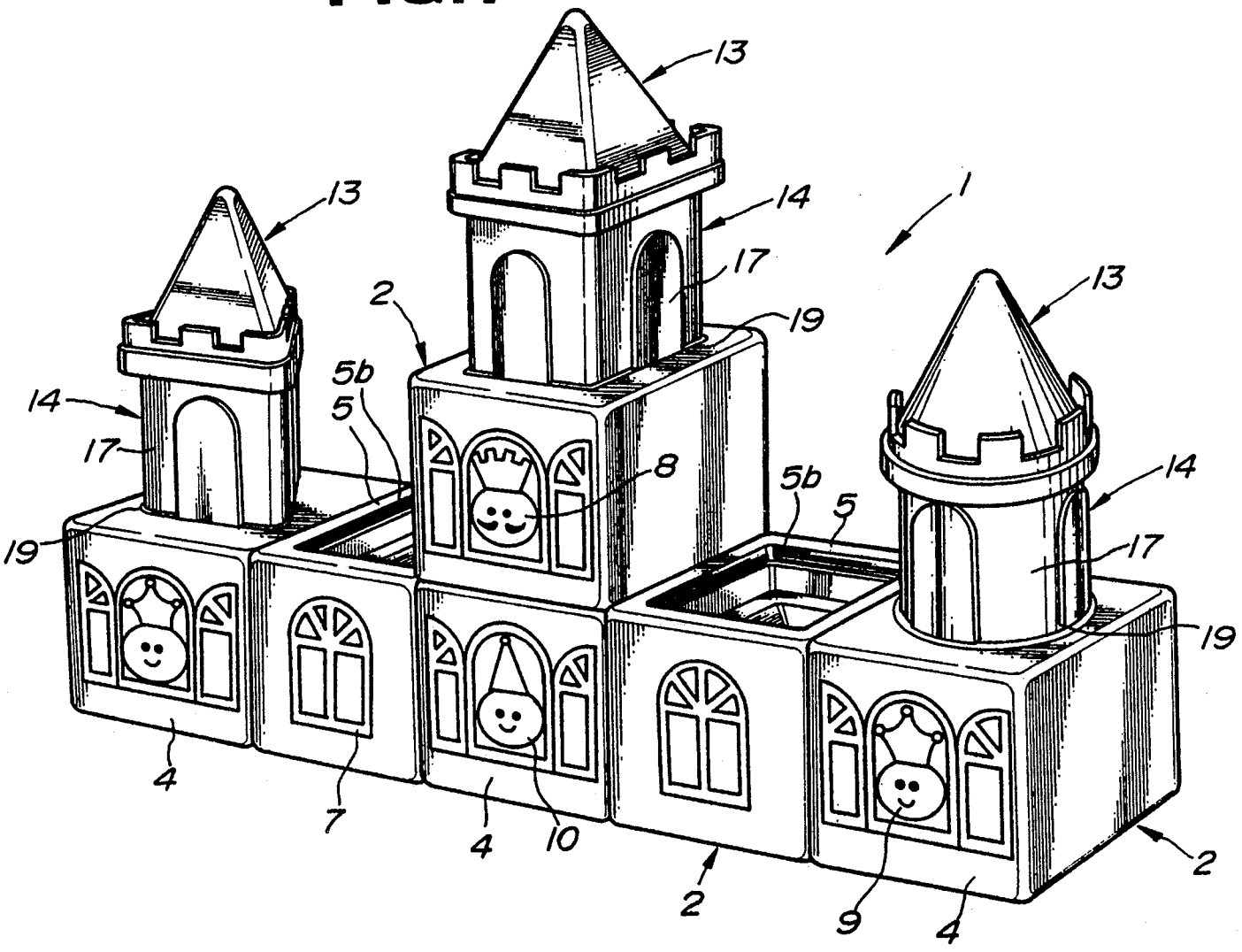
FIG. 1 is a perspective view of blocks, which are assembled in one way, of a block toy according to an embodiment of the present invention.
Figure 2:
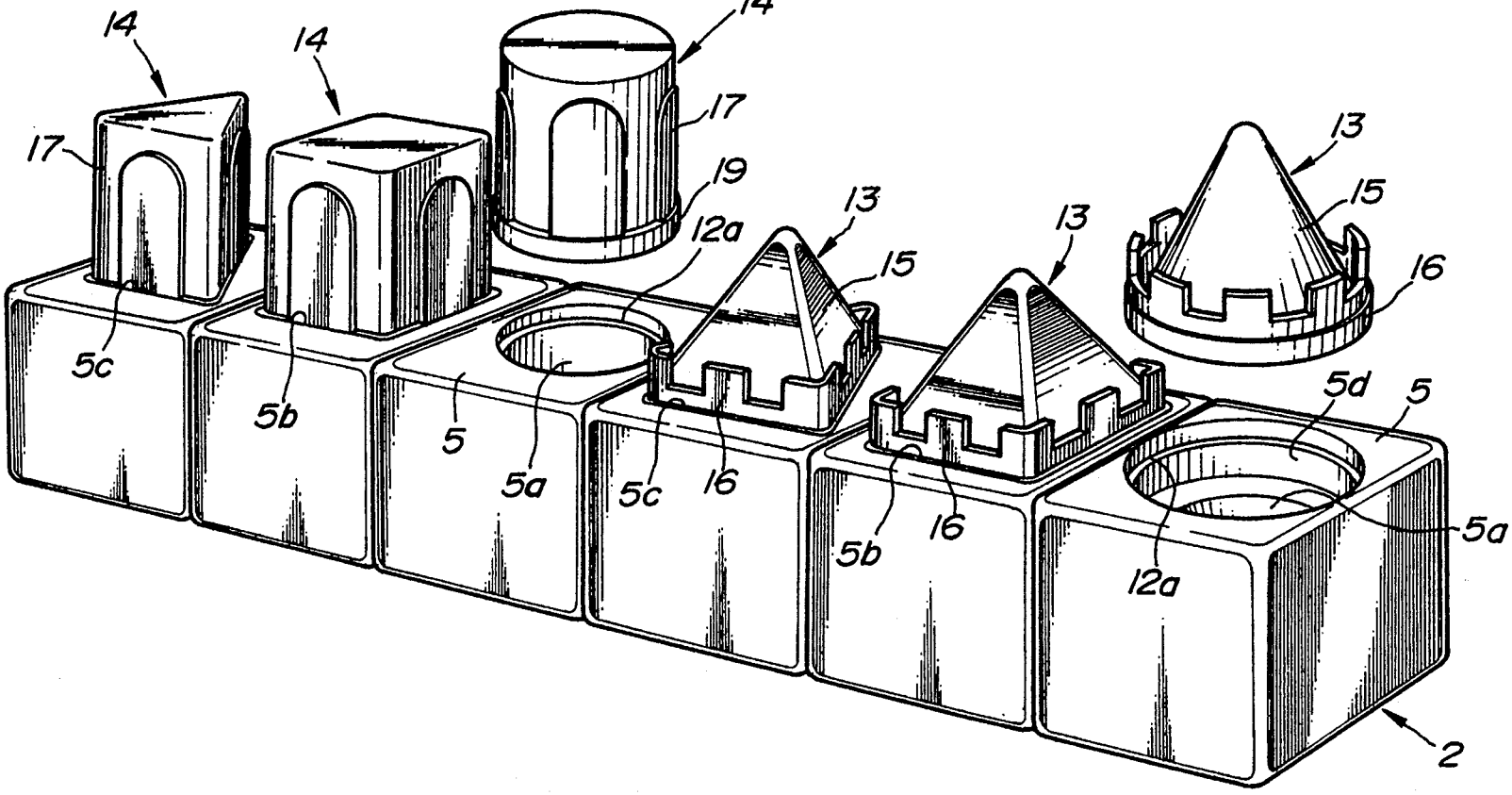
FIG. 2 is a perspective view of the block toy of FIG. 1 in which the blocks are assembled in another way.
Figure 3:
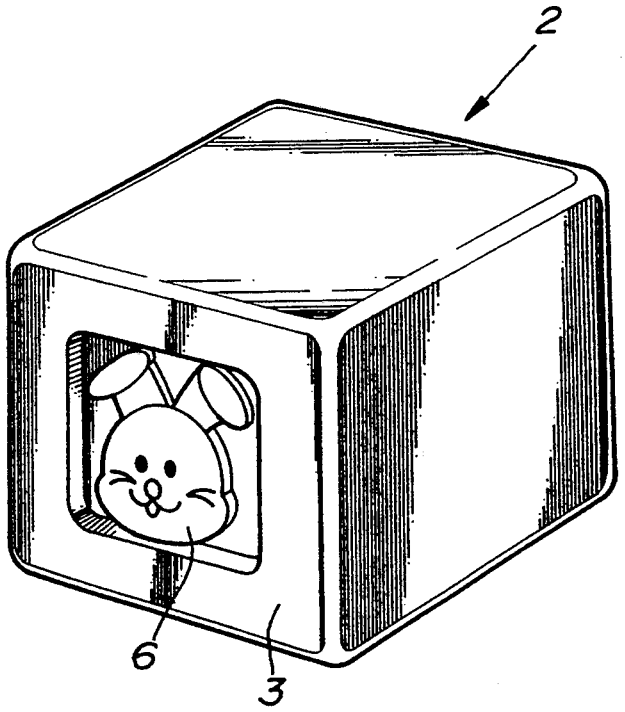
FIG. 3 is a perspective view of one of the blocks of FIG. 1 having a regular hexahedral shape of the blocks, showing a relief side thereof.

As shown in FIGS. 1, 2, and 3, a block toy 1 according to an embodiment of the present invention comprises a plurality of (six in the illustrated embodiment) regular hexahedral blocks 2 each having a relief side 3, a printed side 4, and an apertured side 5 which lies opposite to the relief side 3. Each of the regular hexahedral blocks 2 may have one or two relief sides 3, one or two printed sides 4, and one or two apertured sides 5.

As shown in FIG. 3, the relief side 3 of each hexahedral block 2 has a relief surface representing the face of a rabbit 6. The relief surface may represent any of various other graphic figures. The relief surfaces of the respective hexahedral blocks 2 may bear different graphic representations. As shown in FIG. 1, the printed sides 4 of the respective hexahedral blocks 2 have different printed pictures, i.e., closed windows 7, a king 8 facing out through an open window, a queen 9 facing out through an open window, and a soldier 10 facing out through an open window. Of course, the printed pictures may represent any of various other graphic figures. The printed pictures may be placed on the printed sides 4 in various ways. For example, pictures may actually be printed on the sides 4, or may be transferred to the sides 4 from decals.

The relief sides 3 may comprise relief surfaces that represent these pictures.

The printed sides 4 may carry respective pictures each representing part of a certain figure such as a king, a zoo, or the like so that when the regular hexahedral blocks 2 are properly assembled, the picutres on the printed sides 4 complete such a figure.

The apertured sides 5 have apertures or holes defined therein which include circular apertures 5*a*, square apertures 5*b*, and triangular apertures 5*c*. Each of these apertures 5*a*, 5*b*, 5*c* is defined by a surrounding wall 5*d* (see also FIG. 4A) extending from an outer edge of the apertured side 5 into the regular hexahedral block 2. The surrounding wall 5*d* has an inner step or shoulder 12*a* that is slightly spaced inwardly from the outer edge of the apertured side 5.

Figure 4A:
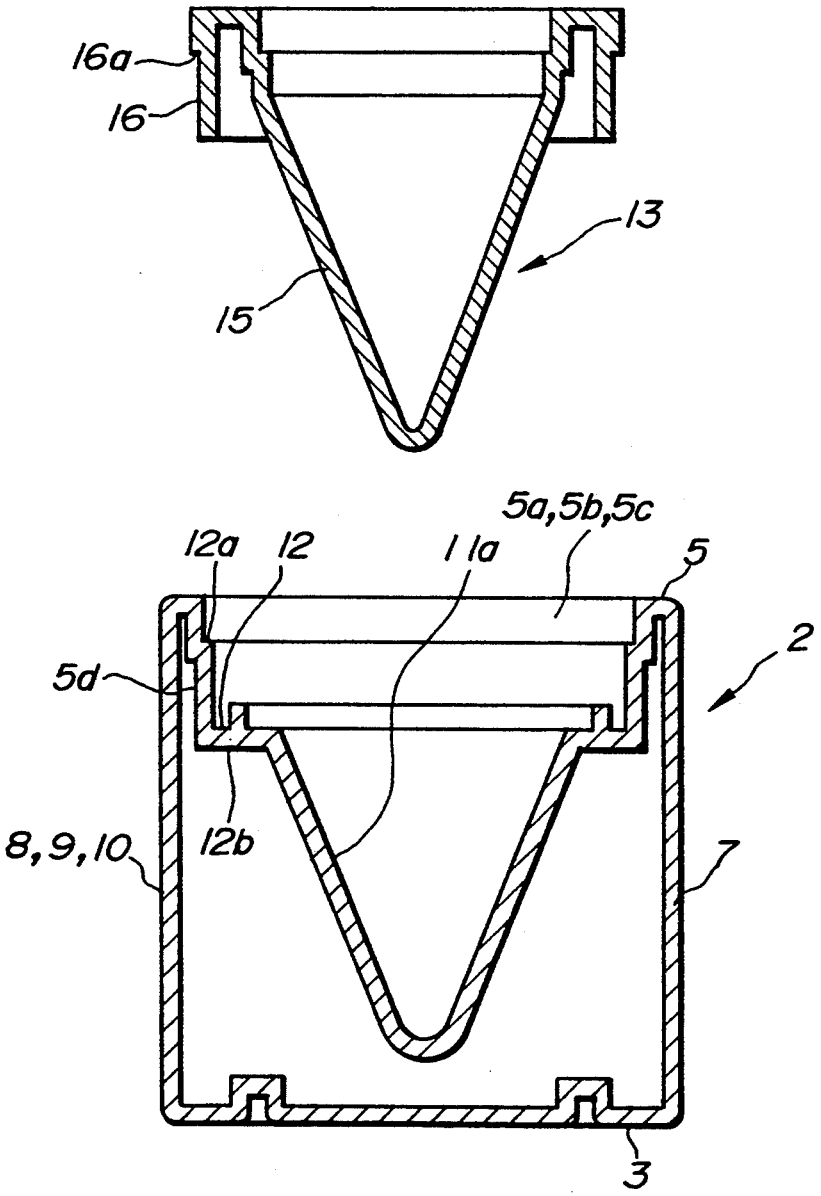
FIG. 4A is an exploded cross-sectional view of a regular hexahedral block and a smaller block of the block toy.

As shown in FIG. 4A, some of the regular hexahedral blocks 2 which have the apertures 5*a*, 5*b*, 5*c* additionally have respective flanges 12*b* extending radially inwardly from the inner edge of the surrounding wall 5*d* and having grooves 12 defined thereon, and respective holders 11*a* extending from inner edges of the flanges 12*b* away from the apertured sides 5. The holders 11*a*, which are of a conical cross section, are in the form of a circular cone, a quadrangular pyramid, and a triangular pyramid, respectively.

Figure 4B:
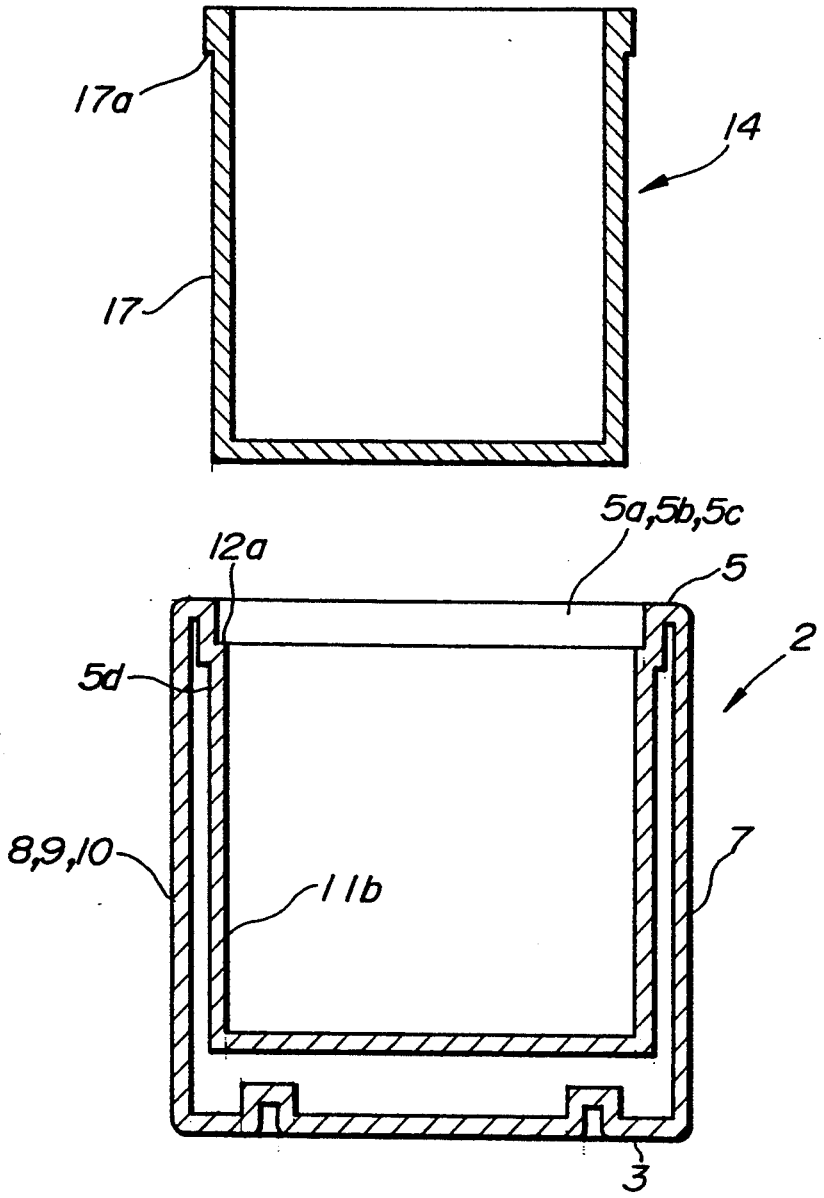
FIG. 4B is an exploded cross-sectional view of another regular hexahedral block and another smaller block of the block toy.

As shown in FIG. 4B, the other regular hexahedral blocks 2 which have the apertures 5*a*, 5*b*, 5*c* additionally have respective holders 11*b* extending from the surrounding walls 5*d* away from the apertured sides 5. The holders 11*b*, which are of a rectangular cross section, are in the form of a circular cylinder, a quadrangular prism, and a triangular prism, respectively.

As shown in FIGS. 1 and 2, the block toy also includes a plurality of (three in the illustrated embodiment) smaller blocks 13 and a plurality of (three in the illustrated embodiment) smaller blocks 14. As also shown in FIG. 4A, the smaller blocks 13 comprise respective roof-shaped projections 15 in the form of a circular cone, a quadrangular pyramid, and a triangular pyramid, respectively, which can complementarily be received in the respective holders 11*a*, and respective irregular marginal edges or flanges 16 extending around the bottoms of the projections 15 and having outer steps or shoulders 16*a*. Each of the smaller blocks 13 thus looks like a tower roof with merlons. When the smaller blocks 13 are directed with the roof-shaped projections 15 pointed upwardly, they can be placed on the apertured sides 5 with the bottoms of the marginal edges 16 placed on the steps 12*a*, as shown in FIG. 2. When the smaller blocks 13 are turned upside down, they can be inserted into the regular hexahedral blocks 2 with the roof-shaped projections 15 being complementarily received in the holders 11*a* and the steps 16*a* engaged by the respective steps 12*a*, as can be seen from FIG. 4A.

As shown in FIGS. 1, 2, and 4B, the smaller blocks 14 comprise respective column-shaped projections 17 in the form of a circular cylinder, a quadrangular prism, and a triangular prism, respectively, which can complementarily be received in the respective holders 11*b*. The projections 17 have respective outer steps or shoulders 17*a*. Each of the smaller blocks 14 thus looks like a tower. When the smaller blocks 14 are directed with the column-shaped projections 17 pointed upwardly, they can be placed on the apertured sides 5 with the bottoms thereof placed on the steps 12*a*, as shown in FIG. 2. When the smaller blocks 14 are turned upside down, they can be inserted into the regular hexahedral blocks 2 with the column-shaped projections 17 being complementarily received in the holders 11*b* and the steps 17*a* engaged by the respective steps 12*a*, as can be seen from FIG. 4B.

The block toy described above may be played with in a variety of different ways. For example, the regular hexahedral blocks 2 may be assembled such that the relief pictures such as the rabbit 6 on the relief sides 3 face toward the player and are combined in a predetermined manner. According to another example, the regular hexahedral blocks 2 may be stacked in two rows with the printed sides 4 facing toward the player, arranging the closed windows 7, the king 8, the queen 9, and the soldiers 10 in a predetermined pattern to complete a castle. If each of the printed pictures on the sides 4 represents part of a certain figure, then the regular hexahedral blocks 2 may be assembled such that the printed pictures are combined thereby to complete the figure.

In addition, the regular hexahedral blocks 2 and the smaller blocks 13, 14 may be put together as building blocks. For example, with the apertured sides 5 facing upwardly, the regular hexahedral blocks 2 may be assembled to arrange the relief sides 3 or the printed sides 4 in a predetermined pattern. Then, the smaller blocks 14 may be removed from the corresponding regular hexahedral blocks 2, inverted, and placed on the apertured sides 5 thereof. Finally, the smaller blocks 13 may be removed from the corresponding regular hexahedral blocks 2, inverted, and placed on the smaller blocks 14 that have been placed on the regular hexahedral blocks 2. Since the smaller block 13 in the form of a circular cone, a triangular pyramid, or a quadrangular pyramid can neatly be positioned only on the smaller block 14 in the form of a circular cylinder, a triangular prism, or a quadrangular prism, respectively the player is required to have a higher level of intelligence and skill than he is when the regular hexahedral blocks 2 are to be arranged to achieve a certain graphic figure combination.

Figure 5:
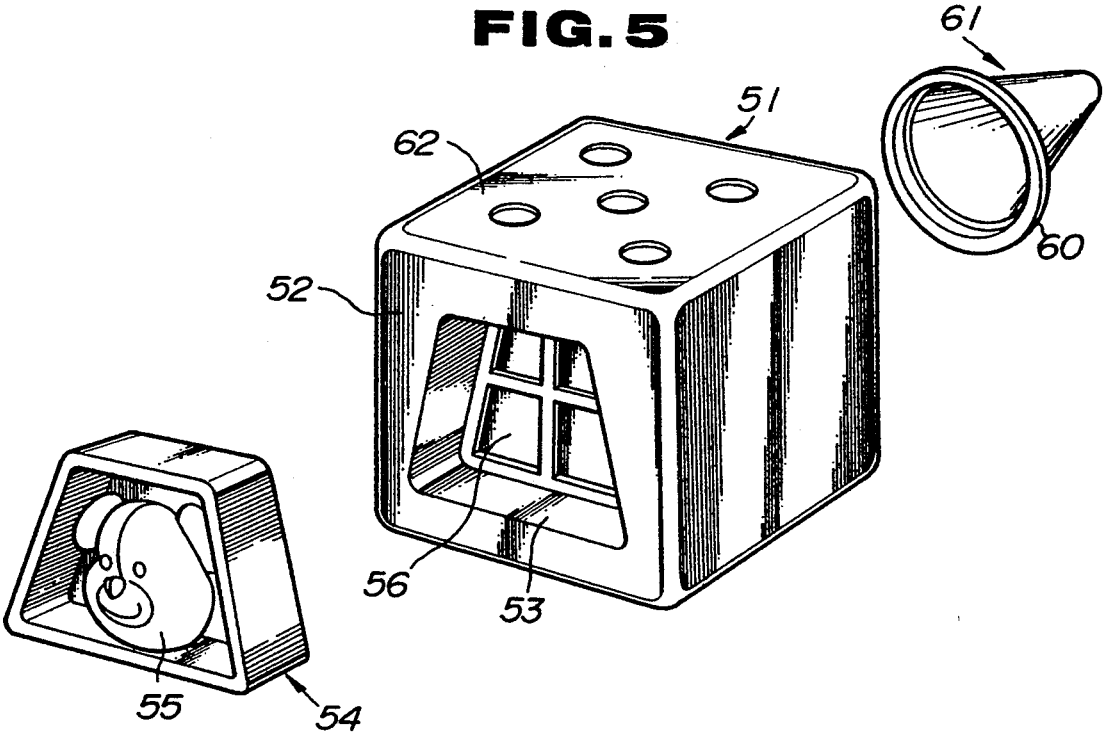
FIG. 5 is an exploded perspective view of blocks of a block toy according to another embodiment of the present invention.
Figure 6:
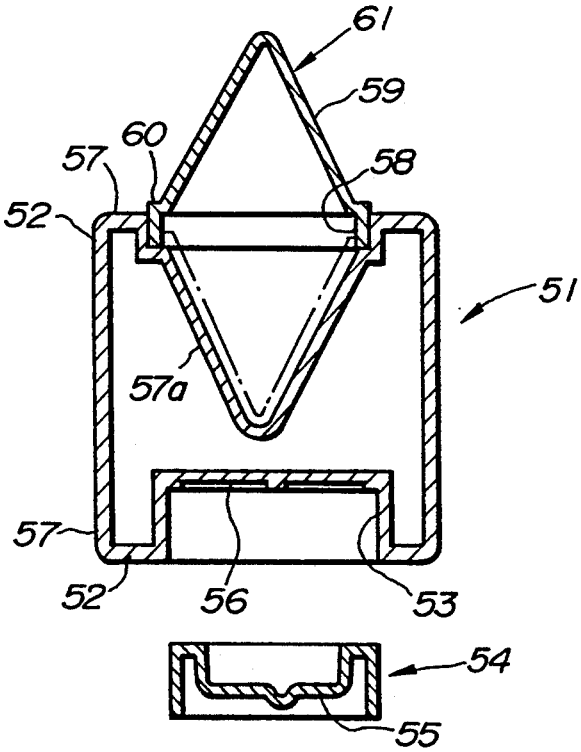
FIG. 6 is a cross-sectional view of the blocks shown in FIG. 5.

FIGS. 5 and 6 show blocks of a block toy according to another embodiment of the present invention. As shown in FIGS. 5 and 6, the block toy includes a regular hexahedral block 51, a smaller block 54, and a smaller block 61. The regular hexahedral block 51 has one or two recessed sides 52 (one shown in FIGS. 5 and 6) each having a recess 53 defined therein and having a window 56, which may appear open or closed. The bottom of the recess 53 is printed with a figure such as a king, a queen, or a soldier, for example, who faces out through the window 56. The smaller block 54 has a relief surface 55, which is shaped as the face of a bear, and can be neatly fitted into the recess 53. The regular hexahedral block 51 also has a relief side 62 adjacent to the recessed side 52. The relief side 62 has a relief surface which represents five dots indicating the number five. The relief surface may of course represent a numeral itself. The relief side 62 may be replaced with a printed side having a printed surface representing a number.

As shown in FIG. 6, the regular hexahedral block 51 further has an apertured side 57 opposite to the recessed side 52, the apertured side 57 having an aperture or hole 58 of a circular shape defined therein. A holder 57*a* in the form of a circular cone extends into the regular hexahedral block 51 from the edge of the aperture 58. The aperture 58 may be rectangular or circular in shape, and the holder 57*a* may be in the form of a quandrangular pyramid or a triangular pyramid. Other sides of the regular hexahedral block 51 may be printed with pictures which may represent independent figures or part of some figure.

The smaller block 61 comprises a projection 59 in the form of a circular cone, which can complementarily be received in the holder 57*a*, and a marginal flange 60 extending around the bottom of the projection 59. The smaller block 61 has a roughened conical outer surface. The smaller block 61 may be in the form of a quadrangular pyramid or a triangular pyramid. As shown in FIG. 6, when the smaller block 61 is placed on the apertured side 57 with the projection 59 projecting outwardly, the regular hexahedral block 51 and the smaller block 61 are combined together into a certain structure.

A plurality of regular hexahedral blocks 51 and smaller blocks 54, 61 may be used to play in a variety of ways. For example, the regular hexahedral blocks 51 may be assembled to combine the printed figures on the printed sides thereof, or to combine the figures on the bottoms of the recesses 53 into different patterns. The regular hexahedral blocks 51 may be arranged in the order represented by the numbers on the relief sides 62 to combine the figures on the printed sides or on the bottoms of the recesses 53, or to complete a single figure of the figure segments on the printed sides. The smaller blocks 54, which may have different relief surfaces 55, may be inserted into the respective recesses 53.

The smaller block 61 may be stored in the corresponding regular hexahedral block 51 as follows: The smaller block 61 on the apertured side 57 is removed and turned upside down. Then, the projection 59 is inserted into the holder 57*a* as indicated by the imaginary lines in FIG. 6.

Figure 7:
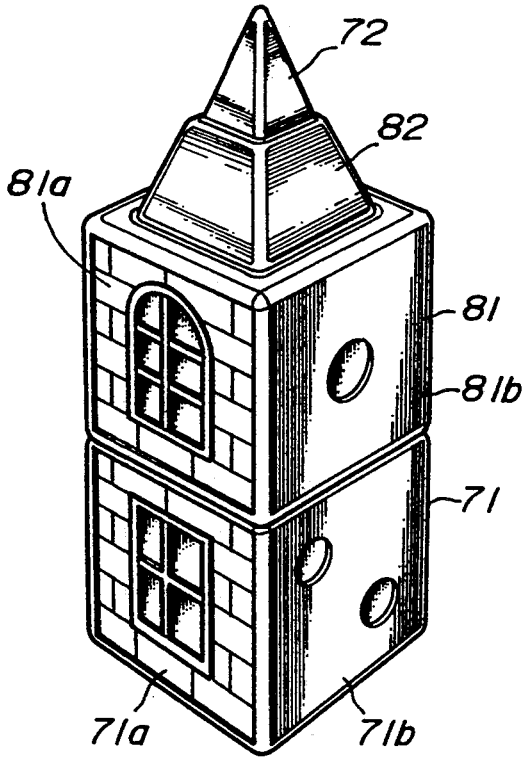
FIG. 7 is a perspective view of assembled blocks of a block toy according to still another embodiment of the present invention.
Figure 8:
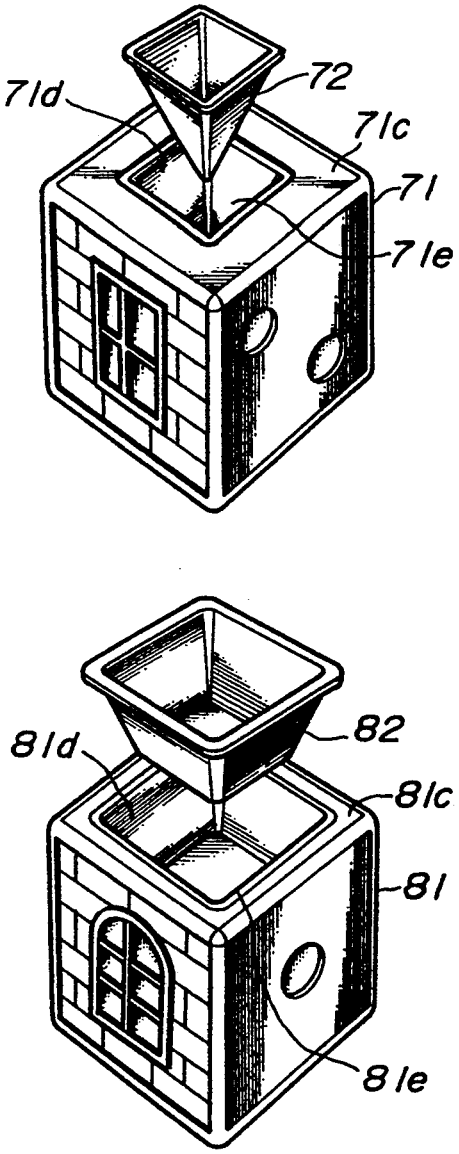
FIG. 8 is an exploded perspective view of the blocks shown in FIG. 7 which are disassembled.
Figure 8A:
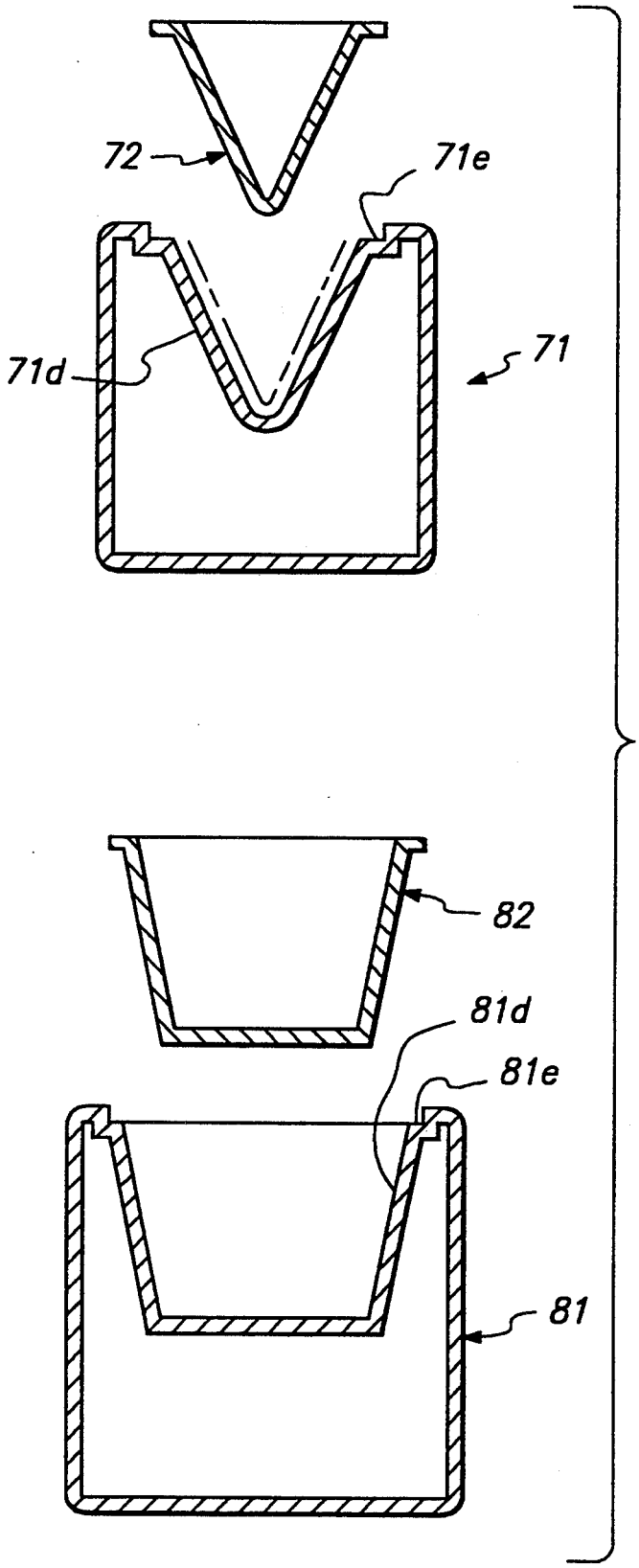
FIG. 8*a* is a cross-sectional view of the blocks shown in FIG. 8.

FIGS. 7, 8 and 8*a* illustrate blocks of a block toy according to still another embodiment of the present invention. As shown in FIGS. 7, 8 and 8*a* the block toy includes regular hexahedral blocks 71, 81 and smaller blocks 72, 82. The regular hexahedral block 71 has at least one relief side 71*a* with a relief surface representing a figure and at least one printed side 71*b* with a printed surface representing a number or a figure. Similarly, the regular hexahedral block 81 has at least one relief side 81*a* with a relief surface representing a figure and at least one printed side 81*b* with a printed surface representing a number or a figure. The smaller block 72 is in the form of a quadrangular pyramid, and the smaller block 82 is in the form of a frustum of a quadrangular prism. The block toy may be played with by placing the regular hexahedral blocks 71, 81 one on the other with the relief sides 71*a*, 81*a* facing in one direction, placing the smaller block 82 on the regular hexahedral block 81, and placing the smaller block 72 on the smaller block 82, as shown in FIG. 7. As shown in FIG. 8, the regular hexahedral block 71 has an aperture side 71*c* with an aperture or hole 71*d* defined therein and a holder 71*e* for complementarily receiving the smaller block 72. Similarly, the regular hexahedral block 81 has an aperture side 81*c* with an aperture or hole 81*d* defined therein and a holder 81*e* for complementarily receiving the smaller block 82. To store the smaller block 72 in the regular hexadral block 71, the smaller block 72 is turned upside down, and placed in the holder 71*e* through the aperture 71*d*. To store the smaller block 82 in the regular hexahedral block 81, the smaller block 82 is turned upside down, and placed in the holder 81*e* through the aperture 81*d*. FIG. 8*a* is a cross-sectional view of the blocks in FIG. 8.

Figure 9:
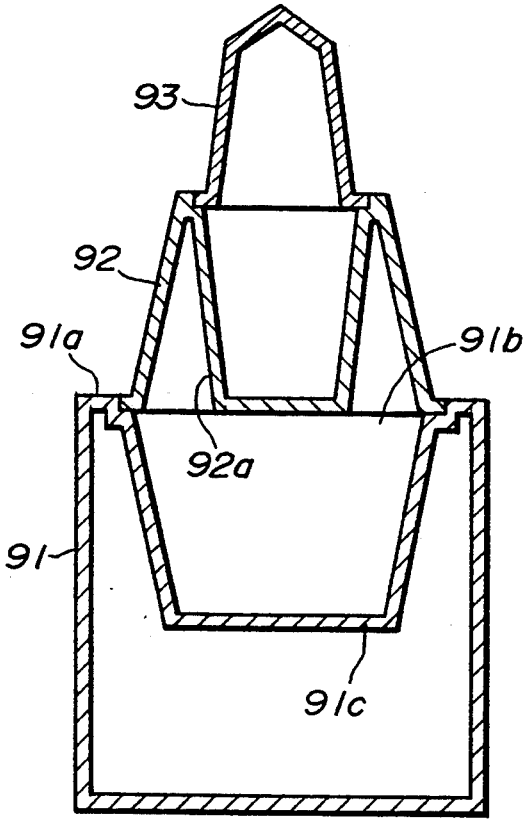
FIG. 9 is a cross-sectional view of assembled blocks of a block toy according to a further embodiment of the present invention.
Figure 10:
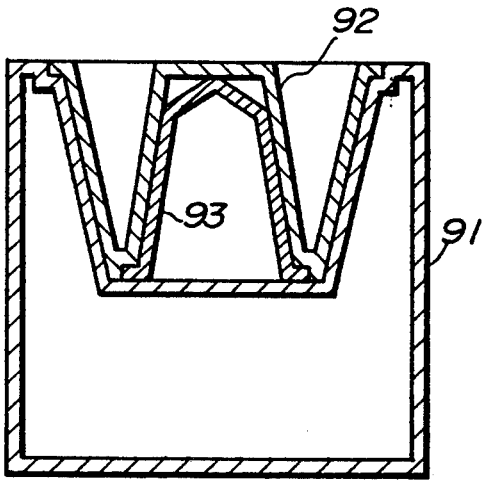
FIG. 10 is a cross-sectional view of the blocks shown in FIG. 9 which are disassembled and stored.

FIGS. 9 and 10 show blocks of a block toy according to a further embodiment of the present invention. As shown in FIG. 9, the block toy comprises a regular hexahedral block 91 and smaller blocks 92, 93. The regular hexahedral block 91 has an apertured side 91*a* with an aperture 91*b* defined therein and a holder 91*c* extending into the regular hexahedral block 91 from the edge the aperture 91*b*. The smaller block 92, which is generally complementary in shape to the holder 91*c*, may be in the form of a frustum of a circular cone, a triangular pyramid, a quadrangular pyramid, or the like. The smaller block 92 has a holder 92*a* disposed therein which is substantially complementary in shape to the smaller block 93 that is smaller than the smaller block 92 and may also be in the form of a frustum of a circular cone, a triangular pyramid, a quadrangular pyramid, or the like. When the blocks 91, 92, 93 are assembled, the smaller block 92 is placed on the regular hexahedral block 91, and the smaller block 92 is placed on the smaller block 92 as shown in FIG. 9. These blocks 91, 92, 93 are disassembled and stored as follows: The smaller block 93 is removed from the smaller block 92, turned upside down, and inserted into the holder 92*a*. The smaller blocks 92, 93 thus combined are then removed from the regular hexahedral block 91, turned upside down, and then inserted into the regular hexahedral block 91, as shown in FIG. 10.

The blocks 91, 92, 93 may have relief sides and/or printed sides which bear some figures and/or numbers.

The block toy shown in FIGS. 9 and 10 may have additional blocks that can be assembled together as building blocks and disassembled and combined together for storage. Such additional blocks, with relief or printed figures, can be played with in a variety of complex ways by players having a higher level of intelligence and skill.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A block toy which may be assembled in various manners to create different graphical images, comprising:

a plurality of regular hexahedral blocks each having at least one side bearing graphic information, and an apertured side; and a plurality of smaller blocks having sizes smaller than said regular hexahedral blocks, each of said smaller blocks being positionable in a first predetermined position on the apertured side of one of said regular hexahedral blocks in secure engagement with an engagement surface of said regular hexahedral block when the smaller blocks are oriented in one direction, and fittable in a second predetermined position within the apertured side of said one of said regular hexahedral blocks in secure engagement with said engagement surface when the smaller blocks are oriented in an opposite direction;

the apertured side of each said regular hexahedral block including a substantially flat surface extending perpendicularly from all adjacent sides of the regular hexahedral block and an aperture defined in a central portion of said substantially flat surface, and the engagement surface of each said regular hexahedral block extending inwardly from said substantially flat surface defining an edge of the aperture.

2. A block toy according to claim 1, wherein said one side comprises at least one of a relief side having a three-dimensional relief surface defining said graphic information and a printed side having a two-dimensional printed surface defining said graphic information, and said graphic information representing at least one of a figure and a number.

3. A block toy according to claim 1, wherein the apertured sides of said regular hexahedral blocks have respective apertures of different shapes, and said smaller blocks comprising different shapes complementary to said different shapes, respectively, of said apertures.

4. A block toy according to claim 3, wherein said regular hexahedral blocks have respective holders disposed therein connected to and extending from edges of said apertures, respectively, said holders having shapes complementary to said smaller blocks for receiving the smaller blocks respectively therein, and said engagement surface of each said regular hexahedral block comprising an outer portion of a corresponding holder relative to the regular hexahedral block.

5. A block toy according to claim 1, further comprising a plurality of further smaller blocks smaller in size than said first-mentioned smaller blocks and positionable on the first-mentioned smaller blocks when said further smaller blocks are oriented in one direction, and each of said further smaller blocks is securely fittable in a predetermined position within the apertured side of one of said regular hexahedral blocks in secure engagement with an engagement surface of the apertured side of said one regular hexahedral block when the further smaller blocks are oriented in an opposite direction.

6. A block toy which may be assembled in various manners to create different graphical images, comprising:

a plurality of regular hexahedral blocks each having a relief side having a three-dimensional relief surface, a printed side having a two-dimensional printed surface, and an apertured side having an aperture defined therein; and a plurality of smaller blocks having sizes smaller than said regular hexahedral blocks, each of said smaller blocks being positionable on the apertured side of one of said regular hexahedral blocks in secure engagement with an engagement surface of said one regular hexahedral block when the smaller blocks are oriented in one direction, and receivable within said one of said regular hexahedral blocks through the aperture in the apertured side thereof such that the smaller block is securely engaged by said engagement surface of said one regular hexahedral block when the smaller blocks are oriented in an opposite direction;

the apertured side of each said regular hexahedral block including a substantially flat surface extending perpendicularly from all adjacent sides of the regular hexahedral block and said aperture of the apertured side being defined in a central portion of said substantially flat surface, and the engagement surface of each said regular hexahedral block extending inwardly from said substantially flat surface to define an edge of the aperture.

7. A block toy according to claim 6, wherein each said relief surface and each said printed surface define graphical information representing at least one of a figure and a number.

8. A block toy according to claim 6, wherein said smaller blocks comprise a plurality of blocks having different cross-sectional shapes, said regular hexahedral blocks having respective holders disposed therein connected to and extending from edges of said apertures, respectively, said holders including said engagement surfaces and having different cross-sectional shapes complementary to said smaller blocks for holding the smaller blocks respectively therein.

9. A block toy according to claim 8, wherein said different cross-sectional shapes include circular, rectangular, and triangular shapes.

10. A block toy according to claim 6, wherein said relief side and said apertured side of each regular hexahedral block lie opposite to each other.

11. A block toy comprising:

a plurality of regular hexahedral blocks each having at least one side bearing graphic information, and an apertured side, said regular hexahedral blocks having respective first holders connected to said apertured sides and disposed in said regular hexahedral blocks;

a plurality of first smaller blocks smaller than said regular hexahedral blocks, each of said first smaller blocks having an apertured side and having a second holder connected to said apertured side and disposed in said first smaller block, each of said first smaller blocks being positionable on the apertured side of one of said regular hexahedral blocks in secure engagement with an engagement surface of the first holder of said regular hexahedral block when the first smaller blocks are oriented in one direction, and fittable in the first holder of one of said regular hexahedral blocks through said apertured side in secure engagement with the engagement surface of the first holder when the first smaller blocks are oriented in an opposite direction; and a plurality of second smaller blocks smaller than said first smaller blocks, each of said second smaller blocks being positionable on one of said first smaller blocks in secure engagement with an engagement surface of the second holder of said first smaller block when the second smaller blocks are oriented in one direction, and fittable in the second holder of one of said first smaller blocks in secure engagement with the engagement surface of the second holder when the second smaller blocks are oriented in an opposite direction;

the apertured side of each said regular hexahedral block and of each said first smaller block includes a substantially flat surface extending perpendicularly from all adjacent sides of the block and an aperture defined in a central portion of said substantially flat surface, and the engagement surface of said first and second holders extend inwardly of said substantially flat surfaces of the regular hexahedral and first smaller blocks from edges of the apertures, respectively.

12. A block toy comprising:

a plurality of regular hexahedral blocks each having at least one side bearing graphic information, and an apertured side, said regular hexahedral blocks having respective first holders connected to and disposed therein:

a plurality of first smaller blocks smaller than said regular hexahedral blocks, said first smaller blocks having respective second holders connected to and disposed therein, each of said first smaller blocks being positionable on the apertured side of one of said regular hexahedral blocks in secure engagement with an engagement surface of the first holder of said regular hexahedral block when the first smaller blocks are oriented in one direction, and fittable in the first holder of one of said regular hexahedral blocks through said aperture in secure engagement with the engagement surface of the first holder when the first smaller blocks are oriented in an opposite direction:

a plurality of second smaller blocks smaller than said first smaller blocks, each of said second smaller blocks being positionable in one of said first smaller blocks in secure engagement with an engagement surface of the second holder of said first smaller block when the second smaller blocks are oriented in one direction, and fittable in the second holder of one of said first smaller blocks in secure engagement with the engagement surface of the second holder when the second smaller blocks are oriented in an opposite direction; and said first and second smaller blocks have different shapes, said first and second holders having shapes complementary to said first and second smaller blocks for receiving the first and second smaller blocks respectively therein.

13. A block toy according to claim 1, wherein said regular hexahedral blocks and said smaller blocks are adapted to be assembled in numerous manners to create different graphical images, said smaller blocks define parts of said different graphical images when said smaller blocks are in said first predetermined position, and said smaller blocks are stored within said regular hexahedral blocks when said smaller blocks are disposed in said second predetermined position such that the smaller blocks do not define parts of different graphical images.

14. A block toy according to claim 1, wherein each of said regular hexahedral blocks also has a recessed side with a recessed surface defined therein, said block toy further comprising a plurality of further smaller blocks, and each of said further smaller blocks being adapted to be fitted in the recessed side of one of said regular hexahedral blocks in secure engagement with said recessed surface thereof.

15. A block toy according to claim 14, wherein said recessed surface of each said regular hexahedral block bears graphic information thereon which is observable when said further smaller blocks are not fitted in the recessed sides of the regular hexahedral blocks, each of said further smaller blocks has at least one side bearing graphic information, and the graphic information on the side of said further smaller blocks is outwardly exposed from the recessed side of the regular hexahedral blocks when said further smaller blocks are fitted in the recessed sides of the regular hexahedral blocks.

16. A block toy according to claim 1, wherein each said smaller block has an engagement surface provided thereon which is adapted to securely engage the engagement surface of one of said regular hexahedral blocks when said smaller block is disposed in said first and second predetermined positions.

17. A block toy according to claim 6, wherein said regular hexahedral blocks and said smaller blocks are adapted to be assembled in numerous manners to create different graphical images, said smaller blocks define parts of said different graphical images when said smaller blocks are in said one orientation, and said smaller blocks are stored within said regular hexahedral blocks when said smaller blocks are disposed in said opposite orientation such that the smaller blocks do not define parts of the different graphical images.

18. A block toy according to claim 6, wherein each of said regular hexahedral blocks also has a recessed side with a recessed surface defined therein, said block toy further comprising a plurality of further smaller blocks, and each of said further smaller blocks being adapted to be fitted in the recessed side of one of said regular hexahedral blocks in secure engagement with said recessed surface thereof.

19. A block toy according to claim 18, wherein said recessed surface of each said regular hexahedral block bears graphic information thereon which is observable when said further smaller blocks are not fitted in the recessed sides of the regular hexahedral blocks, each of said further smaller blocks has at least one side bearing graphic information, and the graphic information on the side of said further smaller blocks is outwardly exposed from the recessed side of the regular hexahedral blocks when said further smaller blocks are fitted in the recessed sides of the regular hexahedral blocks.

20. A block toy according to claim 6, wherein each said smaller block has an engagement surface provided thereon which is adapted to securely engage the engagement surface of one of said regular hexahedral blocks when said smaller block is disposed in said one and opposite orientations.

21. A block toy according to 11, wherein said regular hexahedral blocks, said first smaller blocks and said second smaller blocks are adapted to be assembled in numerous manners to create different graphical images, said first and second smaller blocks define parts of said different graphical images when said first and second smaller blocks are in said one orientation, and said first and second smaller blocks are stored within said regular hexahedral blocks when said first and second smaller blocks are disposed in said opposite orientation such that the first and second smaller blocks do not define parts of the different graphical images.

22. A block toy according to claim 11, wherein each said first smaller block has an engagement surface provided thereon which is adapted to securely engage the engagement surface of one of said first holders when said first smaller block is disposed in said one and opposite orientations thereof, and each said second smaller block has an engagement surface thereon which is adapted to engage the engagement surface of one of said second holders when said second smaller block is disposed in said one and opposite orientations thereof.

* * * * *

UNITED STATES PATENT AND TRADEMARK OFFICE

CERTIFICATE OF CORRECTION

PATENT NO. : 5,354,224
DATED : October 11, 1994
INVENTOR(S) : Shozo Ishiyama

It is certified that error appears in the above-indentified patent and that said Letters Patent is hereby corrected as shown below:

On title page, Item [75] "Inventor:", change "Sozo" to --Shozo--.

Column 6, line 34, change "92" to --93--.

Signed and Sealed this

Twentieth Day of December, 1994

*Attest:*

Bruce Lehman

BRUCE LEHMAN

*Attesting Officer*

*Commissioner of Patents and Trademarks*